US005320416A

United States Patent [19]

Kornberg

[11] Patent Number: 5,320,416

[45] Date of Patent: Jun. 14, 1994

[54] UNIVERSAL ABDUCTION WEDGE FOR A WHEELCHAIR

[76] Inventor: Gary Kornberg, 19 Kathleen Dr. E., Syosset, N.Y. 11791

[21] Appl. No.: 807,712

[22] Filed: Dec. 16, 1991

[51] Int. Cl.[5] ..... A47C 31/00

[52] U.S. Cl. ..... 297/467; 297/DIG. 4

[58] Field of Search ..... 297/467, 403, 406, 410, 297/DIG. 4

[56] References Cited

U.S. PATENT DOCUMENTS

| | | | |
|---|---|---|---|
| 1,531,170 | 3/1925 | Benninghaus | 297/410 |
| 2,765,840 | 10/1956 | Robert et al. | 297/403 |
| 2,784,775 | 3/1957 | Madsen | 297/467 |
| 2,851,084 | 9/1958 | Benjetsky | 297/467 X |
| 3,216,738 | 11/1965 | Bockus | 297/467 X |
| 3,730,589 | 5/1973 | Lane | 297/410 X |
| 3,761,126 | 9/1973 | Mulholland | 297/467 |
| 3,992,057 | 11/1976 | Studebaker | 297/467 |
| 4,102,549 | 7/1978 | Morrison et al. | 297/410 X |
| 4,815,732 | 3/1989 | Mahvi | 297/467 X |

FOREIGN PATENT DOCUMENTS

| | | | |
|---|---|---|---|
| 2150525 | 4/1972 | Fed. Rep. of Germany | 297/467 |

*Primary Examiner*—Jose V. Chen

*Attorney, Agent, or Firm*—Rodman & Rodman

[57] ABSTRACT

The abduction wedge assembly for a wheelchair includes an abduction member joined to a slide, pivot and height extension mechanism that permits the abduction wedge member to be compatibly joined to wheelchairs of selected seat thickness. The slide, pivot and height extension mechanism which is joined to the base of a wheelchair seat includes a slidable member that is longitudinally slidable with respect to a fixed slide guide located at the base of the wheelchair seat. The slide member can be extended to a limit position that permits pivoting of the abduction member from an on-seat position to an off-seat position. The slide, pivot and height extension mechanism further includes a height adjustment member to which the abduction member is joined. The height adjustment member enables the abduction wedge member to be compatibly fitted to wheelchair seats of any thickness. A locking mechanism provided on the slide guide locks the slide member in any selected longitudinally extended position.

21 Claims, 4 Drawing Sheets

Fig. 4
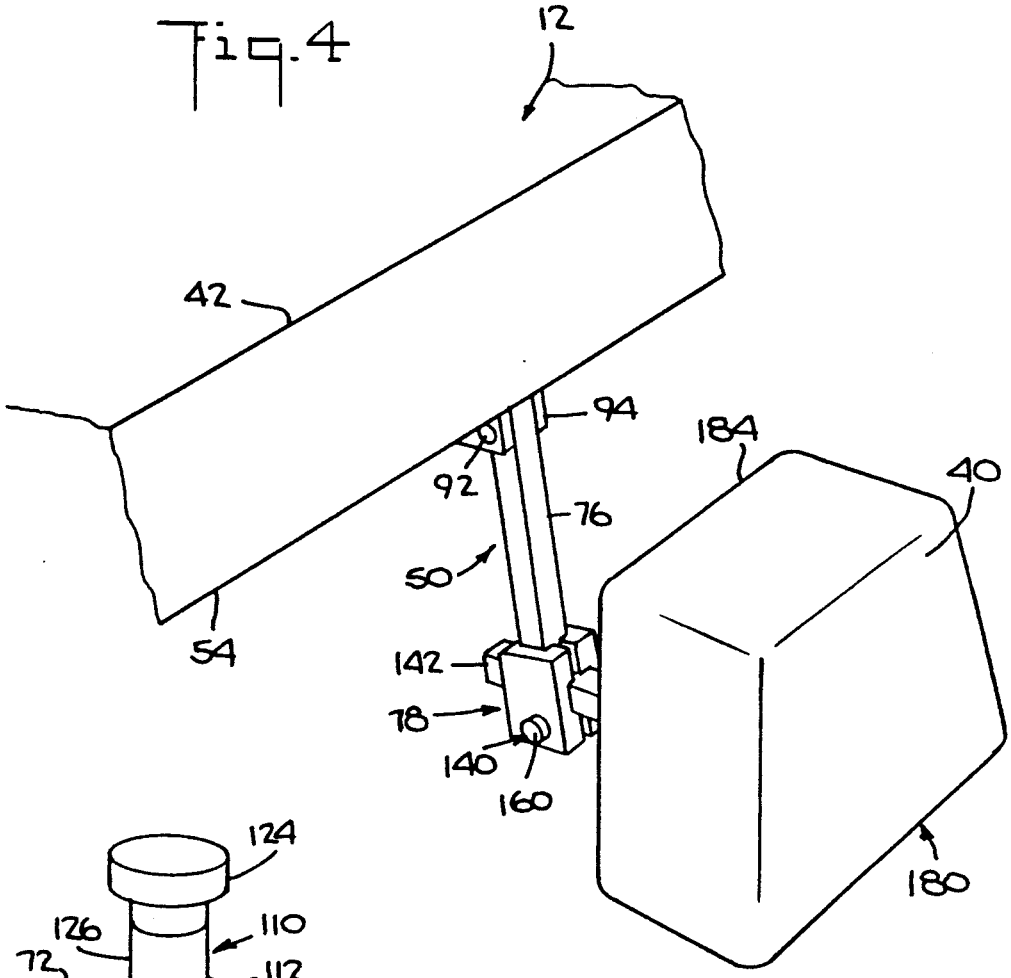
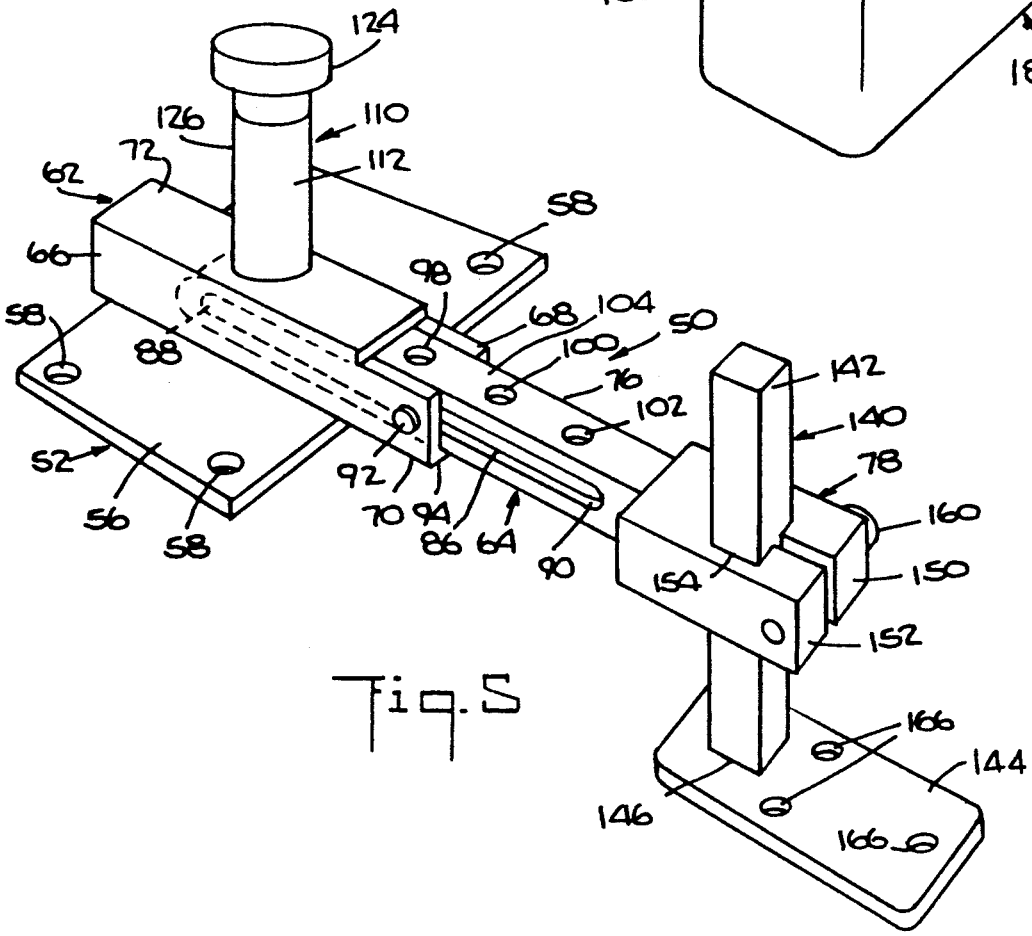
Fig. 5

Fig. 6
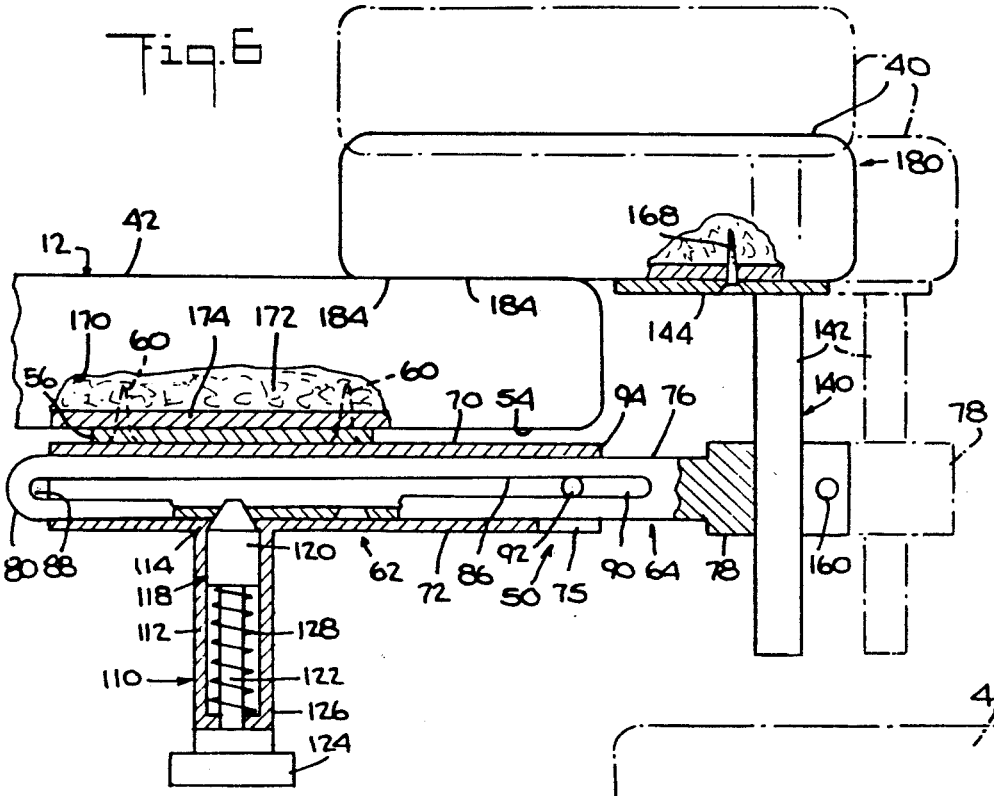
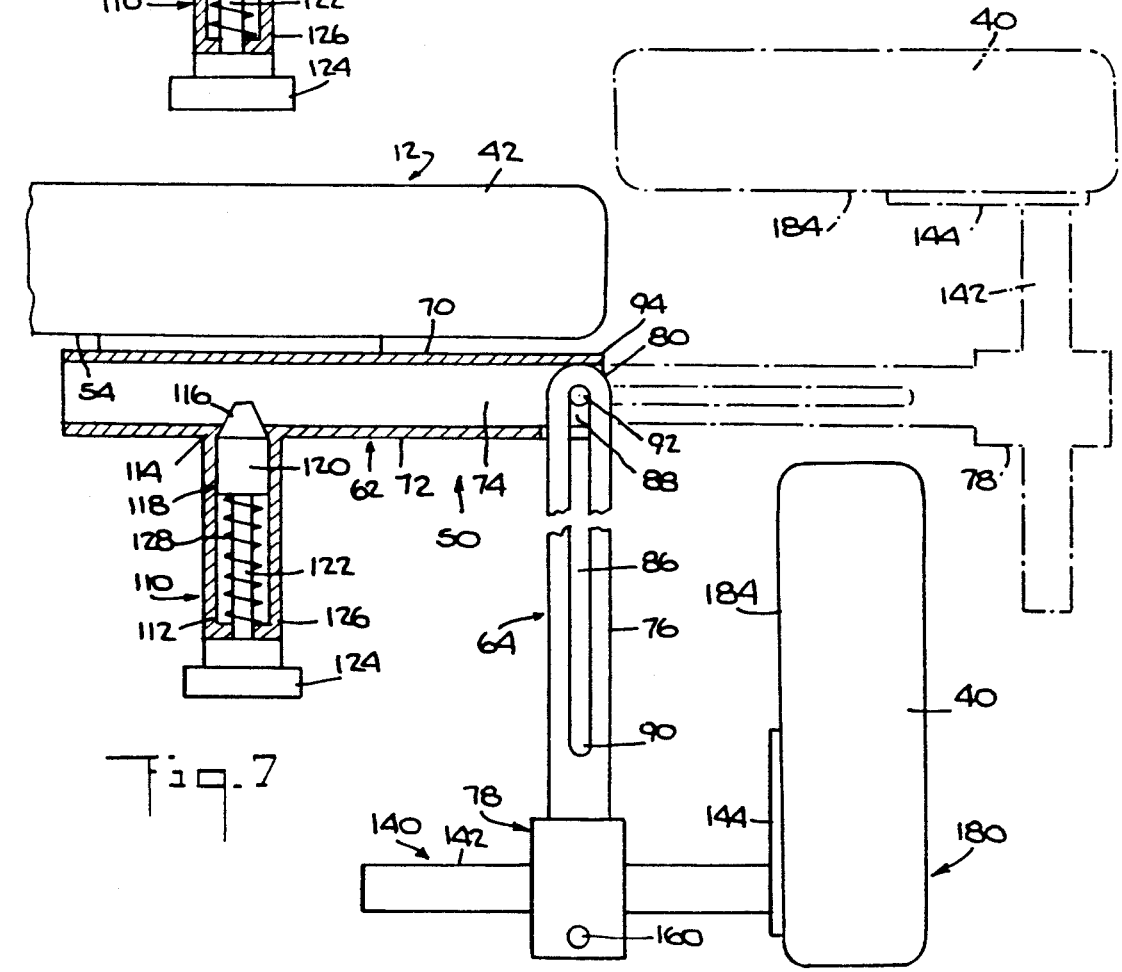
Fig. 7

UNIVERSAL ABDUCTION WEDGE FOR A WHEELCHAIR

BACKGROUND OF THE INVENTION

This invention is directed to accessories for wheelchairs and more particularly to a universal abduction wedge that can be installed on wheelchairs having seats of different thickness.

In many instances persons confined to wheelchairs because of handicapping conditions such as cerebral palsy, have postural abnormalities and positional instability that may require corrective support or stabilization. For example in individuals with lower extremity spasticity, the knees tend to converge or pull over each other in a manner which can cause hip dislocation.

One known device for limiting knee convergence and pull over is an abduction wedge that is located on a wheelchair seat between the knees and thighs. The abduction wedge keeps the legs separated and thus helps to prevent hip dislocation. The abduction wedge also helps prevent soft tissue contractures and limits forward movement of an individual's pelvis in the chair thereby preventing slippage from the chair.

Abduction wedges have various sizes and shapes such as exemplified in U.S. Pat. Nos. 3,216,738; 3,761,126; 3,992,057; 4,165,127; 4,192,546 and 4,579,390.

Seating devices and chairs for infants and young children are also known to include a spacer or restraining member disposed between a child's legs to limit forward movement of the child as shown in U.S. Pat. Nos. 2,784,775; 2,851,084 and 3,037,813.

While the abduction wedge is highly beneficial in maintaining separation of the legs of a wheelchair occupant, it can also be an obstacle. For example, wheelchair occupants often require assistance when being transferred to or from the wheelchair. Many wheelchair occupants must be bodily lifted during such transfer which can be an awkward and strenuous procedure, especially for a caregiver who does the lifting. The awkwardness and physical demands of a wheelchair transfer procedure are further compounded if the wheelchair occupant must be lifted over an abduction wedge. In such instances, more than one caregiver may be required to assist in the transfer of the wheelchair occupant. Furthermore, if the wheelchair occupant is inadvertently lifted against or dropped against an abduction wedge, the resultant impact or rubbing can cause injury to the wheelchair occupant.

In response to this problem, some known abduction wedges can be temporarily removed or pivoted from an on-seat position to an off-seat position to facilitate transfer of the wheelchair occupant. When pivoted to a off-seat position the abduction wedge is usually disposed at the front lower leg portion of the chair. Thus with an abduction wedge in an off-seat position the transfer procedure is facilitated.

Abduction wedges that are pivotable from one position to another on a wheelchair are usually adapted to a specific seat thickness of a wheelchair. Thus an abduction wedge manufactured for a wheelchair having a specific seat thickness generally cannot be used on a wheelchair seat of another thickness.

It is thus desirable to provide an abduction wedge for a wheelchair that can be universally fitted onto wheelchair seats of different thickness and can also be pivoted away from the wheelchair seat to facilitate transfer of a wheelchair occupant.

OBJECTS AND SUMMARY OF THE INVENTION

Among the several objects of the invention may be noted the provision of a novel abduction wedge for a wheelchair, a novel abduction wedge for a wheelchair that is universally adaptable to wheelchairs of different seat thickness, a novel abduction wedge for a wheelchair that is adjustable to correspond to a predetermined seat thickness of a wheelchair, a novel abduction wedge for a wheelchair that is adjustable to a given seat thickness of a wheelchair and is pivotable from an on-seat position to an off-seat position to facilitate transfer of a wheelchair occupant, a novel abduction wedge for a wheelchair that can be easily installed on different wheelchairs with different seat thickness and easily pivoted from an on-seat position to an off-seat position, and a novel abduction wedge for a wheelchair that is durable and easily dismantled to permit cleaning.

Other objects and features of the invention will be in part apparent and in part pointed out hereinafter.

In accordance with one embodiment of the invention, the abduction wedge for a wheelchair includes a support means that can be affixed to the bottom surface of a wheelchair seat using screws or any other suitable fasteners. The support means includes a slide guide or guide member that accommodates a slide member. The slide member has a slot which receives a pivot member held by the slide guide.

Under this arrangement the slide member can move in a forward longitudinal direction toward the front of the wheelchair seat or in a rear longitudinal direction toward the rear of the wheelchair seat. The amount of forward or rearward movement of the slide member is determined by the extent of the slot.

The slide member has a forward limit position in which the slide member can be pivoted relative to the support means. A notch or recess is provided in the slide guide to allow clearance for pivotal movement of the slide member relative to the slide guide. The pivot position of the slide member is essentially a forward longitudinal limit position of the slide member relative to the guide member.

The slide member can be locked into one or more selected longitudinal positions in the guide member before reaching the forward limit position. Locking of the slide member into a selected longitudinal position is accomplished with a releasable locking mechanism. The locking mechanism includes a spring biased latch on the slide guide that is engagable with one or more latch receiving openings in the slide member. The latch can be manually disengaged from a selected locking position to permit slidable movement of the slide member relative to the guide member.

The abduction wedge also includes a height adjustment member laterally movable relative to the slide member. Lateral movement of the height adjustment member in one direction protracts the height adjustment member from the slide member, whereas lateral movement of the height adjustment member in the opposite direction retracts the height adjustment member relative to the slide member. A height adjustment locking device is provided on the slide member to lock the height adjustment member into a selected protracted position relative to the slide member.

The height adjustment member also includes a holding base to which an abduction wedge member is fastened or otherwise joined.

Under this arrangement the abduction wedge member is height adjustable with respect to the slide member to correspond to a predetermined thickness of a wheelchair seat. The abduction wedge member can also be pivoted with the slide member from an on-seat position to an off-seat position to facilitate transfer of a wheelchair occupant.

The abduction wedge is thus easily installed and simple to adjust to obtain compatibility with a particular wheelchair seat. No skill is needed to shift the abduction wedge from its on-seat position to an off-seat position.

The invention accordingly comprises the constructions and method hereinafter described, the scope of the invention being indicated in the claims.

DESCRIPTION OF THE DRAWINGS

In the accompanying drawings,

FIG. 4 is a simplified perspective view thereof with the abduction wedge member pivoted to an off-seat position;

FIG. 5 is a simplified perspective view of the abduction wedge mechanism;

FIG. 6 is an elevational view thereof, partly shown in section, wherein the abduction wedge is in an on-seat position and wherein the mechanism is height adjustable for wheelchair seats of different thickness as shown in dotted outline, a further dotted outline showing the longitudinal movement capability of the abduction wedge; and, FIG. 7 is a view similar to FIG. 6 showing the abduction wedge pivoted to an off-seat position, the abduction wedge being shown in dotted outline at a forward longitudinal limit position prior to being pivoted.

Corresponding reference characters indicate corresponding parts throughout the several views of the drawings.

DETAILED DESCRIPTION OF THE INVENTION

Figure 1:
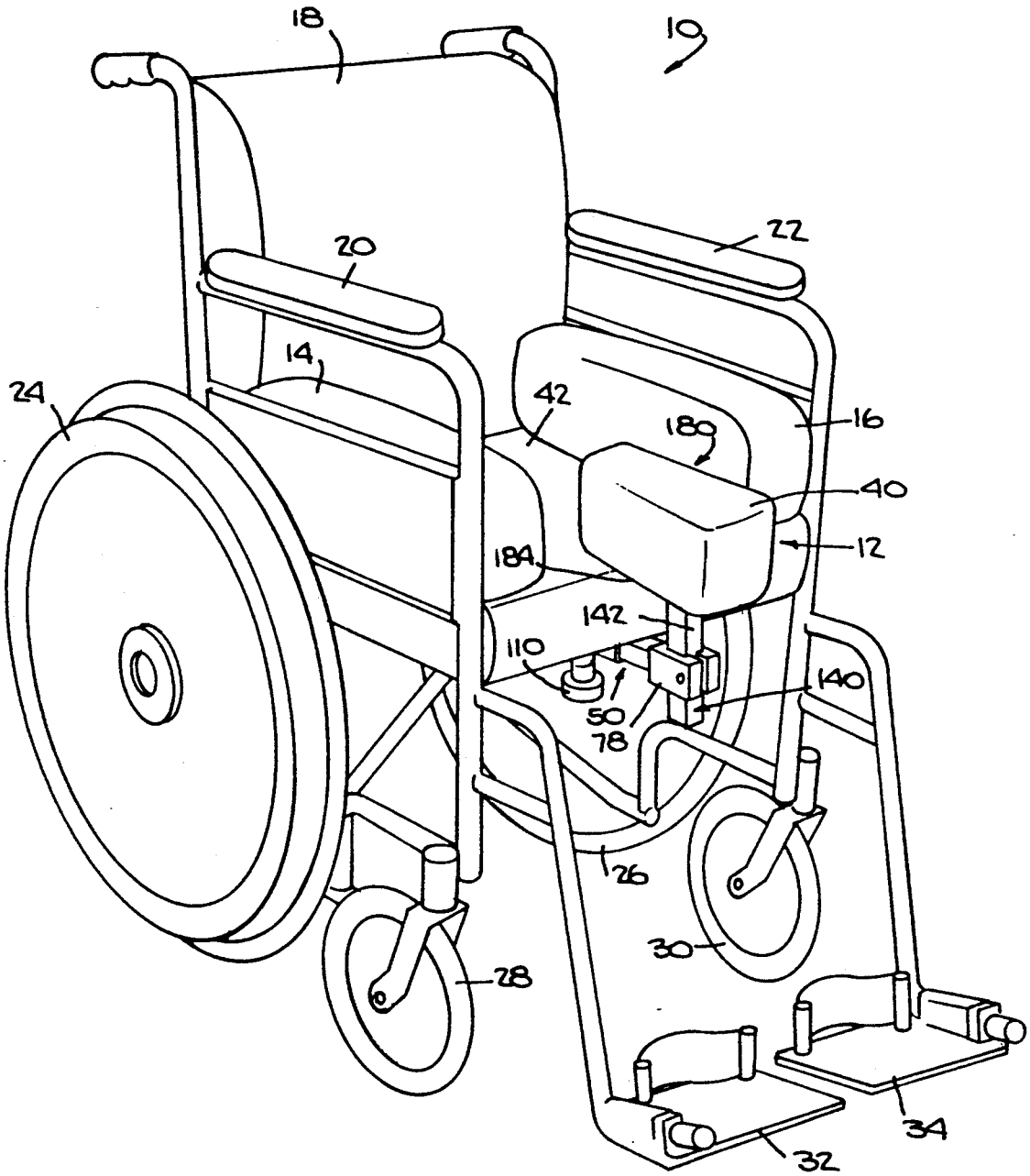
FIG. 1 is a simplified perspective view of an abduction wedge incorporating one embodiment of the invention, assembled to a wheelchair.

A wheelchair incorporating one embodiment of the invention is generally indicated by the reference number 10 in FIG. 1.

The wheelchair 10 includes a seat 12 having side cushions 14 and 16, a back rest 18 and arm rests 20 and 22. The wheelchair further includes a pair of rear wheels 24 and 26, a pair of forward wheels 28 and 30 and a pair of foot rests 32 and 34.

The wheelchair 10 further includes an abduction wedge member 40 located in an on-seat position wherein the member 40 is disposed against a top surface 42 of the wheelchair seat 12. The abduction wedge member 40 is joined to a slide, pivot and height extension mechanism 50, most clearly shown in FIG. 5.

Referring to FIGS. 5–7, the mechanism 50 includes a support means 52 adapted to be joined to a base surface 54 of the wheelchair seat 12. The support means 52 thus includes an attachment plate 56 having openings 58 which receive screws 60 (FIG. 6) that secure the attachment plate 56 to the base surface 54 of the wheelchair seat 12.

The support means 52 further include a slide guide or guide member 62 adapted to slidably receive a slide member 64. The slide guide 62 is preferably in the form of a generally rectangular elongated sleeve welded or otherwise joined to the attachment plate 56.

Referring to FIGS. 5–7, the slide guide 62 includes opposite side walls 66 and 68, a floor section 70 joined to the attachment plate 56 and an opposite floor section 72 of shorter longitudinal extent than the side walls 66 and 68. The side walls 66, 68 and the floor sections 70 and 72 thus define a reception space 74 (FIG. 7) for accommodation of the slide member 64. The foreshortened floor section 7 defines a clearance space 75, most clearly shown in FIG. 6.

The slide member 64 includes an elongated stem section 76 that is generally rectangular in cross-section, joined to a clamping section 78 of slightly larger rectangular cross-section than the stem section 76. The stem section 76 includes a free end 80 (FIGS. 6 and 7) that can be finished with a radius as shown. If desired, the free end 80 can be squared off (not shown).

An elongated slot 86 is formed in the stem section 76 and has opposite end portions 88 and 90 (FIGS. 6 and 7). A pivot pin 92 supported in the side walls 66 and 68, extends through the slot 86 with sufficient clearance so as not to affect the slidable movement of the stem portion 76 relative to the slide guide 62. Under this arrangement, longitudinal movement of the stem section 76 in a rearward direction such as to the left as shown in FIG. 5, can be limited by engagement between the end portion 90 of the slot 86 and the pivot pin 92, or by engagement between the clamping section 78 and an end portion 94 of the slide guide 62.

The stem portion 76 includes a plurality of tapered openings such as 98, 100 and 102 (FIG. 5) formed in a surface 104.

A locking mechanism 110 for detenting or locking the position of the slide member 64 into a selected longitudinal position in the slide guide 62 includes a tubular member 112 joined at an open end 114 (FIGS. 6 and 7) to the floor section 72 The floor section 72 is provided with an opening 116 (FIG. 7) that registers with the open end 114. The tubular member 112 is provided with a plunger member 118 having a tapered head 120 and a reduced elongated shaft 122 joined to a knob 124 that projects from a free end 126. A biasing spring 128 is provided between the tapered head 120 and the free end 126 to bias the tapered head 120 out of the openings 114 and 116 to engage any one of the tapered openings 98, 100, 102 in the slide member 64.

Thus longitudinal adjustment of the slide member 64 relative to the slide guide 6 is accomplished by manually pulling the knob 124 to retract the tapered head 120 in the tubular member 112, sliding the slide member 64 within the slide guide 62 to a selected longitudinal position and then releasing the knob 124 to allow the tapered head 120 to engage a selected opening 98, 100, 102, which engagement prevents movement of the slide member 64 in the slide guide 62.

Pivotal movement of the slide member 64 relative to the slide guide 62 is obtained by longitudinally extending the slide member 64 from the slide guide 62 to a position wherein the end portion 90 of the slot 86 engages the pivot pin 92 in the manner shown in FIG. 7. The free end portion 80 of the slide member 64 is thus positioned in the clearance space 75 at the end portion 94 of the slide guide 62. The clearance space 75 thus provides clearance for the free end 80 of the slide member 64 to pivot relative to the slide guide 62 in the manner shown in FIG. 7.

The mechanism 50 further includes a height adjustment means 140 held in the clamping section 78 of the slide member 64. The height adjustment means 140 includes a height adjustment member 142 which is generally rectangular in cross-section and a base plate member 144 joined to an end 146 of the height adjustment member 142.

The clamping section 78 includes a pair of jaw members 150 and 152 which define a generally rectangular opening 154 (FIG. 5) that receives the height adjustment member 142. The rectangular opening 154 of the jaw members 150 and 152 corresponds in size to that of the cross section of the height adjustment member 142. The jaw members 150 and 152 which are spaced from each other, include a locking screw 160 for tightening or loosening the grip of the jaw members on the height adjustment member 142. The height adjustment member 142 can thus be held in a protracted position, wherein the base plate member 144 is moved away from the clamping section 78, or retracted, wherein the base plate member 144 is moved toward the clamping section 78. The clamping section 78 thus incorporates a locking means for locking the height adjustment member 142 in a desired protracted or retracted position.

The base plate member 144 includes fastener openings 166 (FIG. 5) that receive screws 168 (FIG. 6) for securement of the abduction wedge member 40 to the base plate member 144 in the manner shown in FIG. 6.

The abduction wedge member 40 is of trapezoidal shape and includes an outside covering 170 (FIG. 6) which can be formed of plastic, vinyl or any other suitable material. The cover 170 encloses an inner foam material 172 supported on a rigid member 174.

As shown in FIG. 6, the abduction wedge member 40 is relatively larger than the base plate member 144 and extends longitudinally beyond the base plate member 144, such that the abduction wedge member 40 is essentially cantilevered on the height adjustment member 142.

It should be noted that the abduction wedge member 40 is of any suitable known structure and the size and shape thereof are a matter of choice, depending upon the particular needs of the wheelchair occupant.

The combination of the abduction wedge member 40 and the slide, pivot and height extension mechanism 50 will hereinafter be referred to as an abduction wedge assembly 180. In using the abduction wedge assembly 180, the attachment plate 56 is joined to the base surface 54 of the seat 12 in the manner previously described. The slide member 64 is thus slidably movable within the slide guide 62 to move the abduction member 40 in a longitudinally rearward direction toward the back rest 18 or in a longitudinally forward direction away from the back rest 18.

The abduction member 40 is disposed against the top surface 42 of the seat 12 by loosening the lock screw 160 in the jaw members 150 and 152 of the clamping section 78 to permit movement of the height adjustment member 142 relative to the clamping section 78. The height adjustment member 142 is retracted into the clamping section 78 until a undersurface 184 of the abduction member 40 just contacts the top surface 42 of the seat 12. The locking screw 160 can then be tightened to maintain the adjustment member 142 at a fixed position wherein the abduction member 40 has an on-seat position that corresponds to the thickness of the seat 12.

Since the height adjustment member 142 is adjustable to selected positions relative to the clamping section 78, the abduction member 40 can be set at any selected height from the clamping section 78 to correspond with any seat thickness of a wheelchair. The abduction wedge assembly 180 is thus universally adaptable to wheelchairs with different seat thickness.

Figure 2:
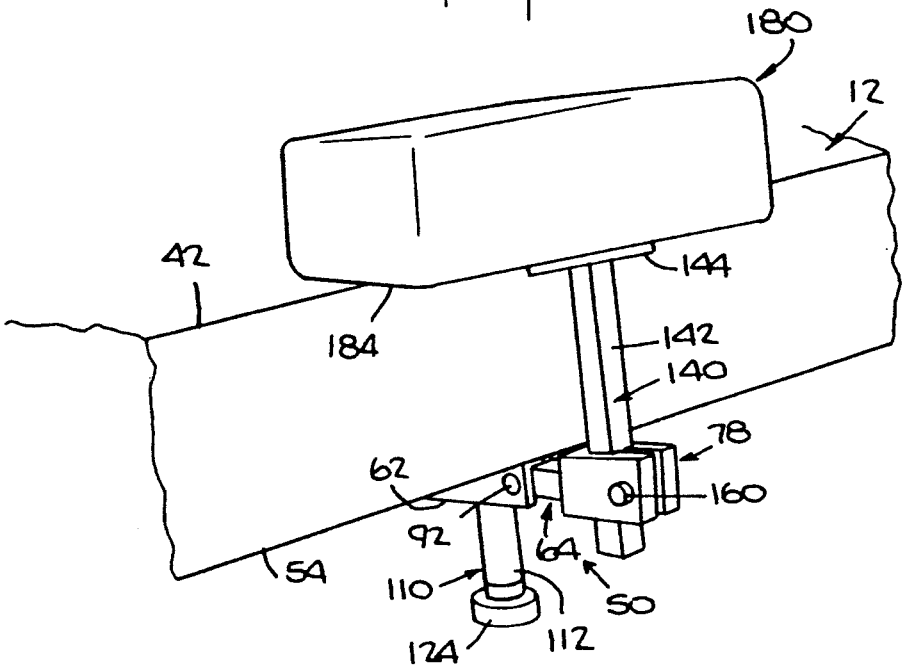
FIG. 2 is a simplified perspective view thereof with the abduction wedge member in an on-seat position.
Figure 3:
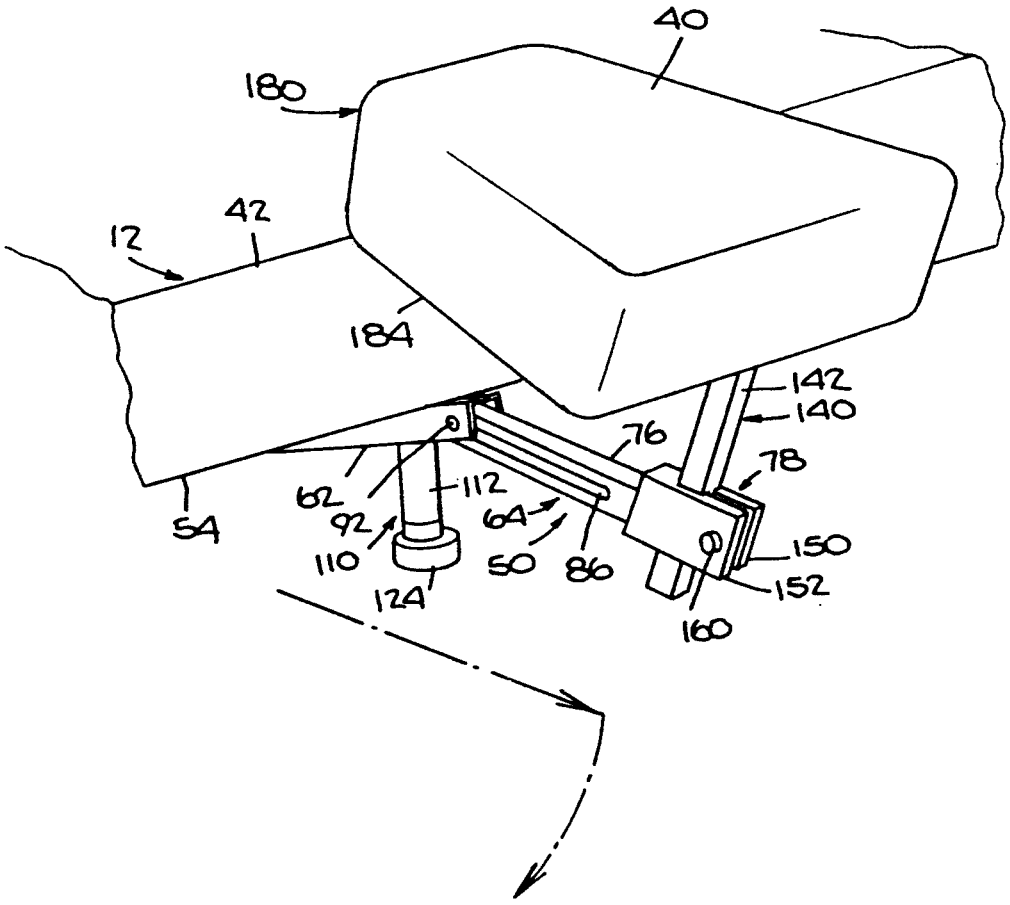
FIG. 3 is a simplified perspective view thereof wherein the abduction wedge is being pivoted from an on-seat position to an off-seat position.

The abduction wedge member 40 is pivotable from an on-seat position such as shown in FIGS. 2 and 6, to an off-seat position such as shown in FIG. 7 by longitudinally extending the slide member 64 into a forward limit position wherein the end portion 88 of the slot 86 engages the pivot pin 92. The slide member 64 is thus pivotable with respect to the slide guide 62, in the manner previously described, to move the abduction wedge member 40 from the on-seat position of FIG. 6 to the off-seat position of FIG. 7.

Some advantages of the present invention evident from the foregoing description include an abduction wedge assembly for a wheelchair that is universally adaptable to wheelchairs having different seat thicknesses. A further advantage is that the abduction wedge member can be pivoted from an on-seat position to an off-seat position to facilitate transfer of a wheelchair occupant to or from the wheelchair without having to bodily lift the occupant over and around an on-seat abduction wedge.

A further advantage is that the abduction wedge member is longitudinally adjustable in the on-seat position to one or more selected positions. Still another advantage is that the abduction wedge assembly can be easily assembled to a wheelchair and can likewise be easily disassembled for cleaning or any other maintenance purpose.

For example, the abduction wedge member 40 and the height adjustment member 142 can be removed from the clamping section 78 by merely loosening the locking screw 160. Thus replacement of one abduction wedge member with another abduction wedge member because of wear, tear or any other reason, is easily and conveniently accomplished. Although the abduction wedge member can be easily pivoted from an on-seat position to an off-seat position, access to the locking mechanism which permits longitudinal movement and eventual pivoting of the abduction wedge member is sufficiently remote to prevent any inadvertent adjustment or pivoting of the abduction wedge member.

In view of the above, it will be seen that the several objects of the invention are achieved and other advantageous results attained.

As various changes can be made in the above constructions without departing from the scope of the invention, it is intended that all matter contained in the above description or shown in the accompanying drawings shall be interpreted as illustrative and not in a limiting sense.

What is claimed is:

1. An abduction wedge assembly for a wheelchair comprising, a) support means adapted to be joined to a wheelchair, b) slide means joined to said support means and including a slide member and means for accommodating slidable movement of said slide member such that said slide member is slidably movable in a longitudinal direction relative to said support means to selected longitudinally directed positions, c) height adjustment means joined to said slide member including a height adjustment member movable in a lateral direction relative to aid slide member when said slide member is in said selected longitudinally directed positions, and d) said slide means including means for pivotable movement of said with respect to said support means when said slide member is in a predetermined longitudinally directed position.

2. An abduction wedge assembly for a wheelchair as claimed in claim 1 including an abduction wedge member joined to said height adjustment means for height adjustment relative to said support means when said slide member is in said selected longitudinally directed positions, said abduction wedge member and said height adjustment member being pivotable with said slide member when said slide member is in said predetermined longitudinally directed position.

3. An abduction wedge assembly for a wheelchair as claimed in claim 2 wherein said height adjustment member includes a base plate member, said abduction wedge member being joined to said base plate member.

4. An abduction wedge assembly for a wheelchair as claimed in claim 1 wherein said support means include an attachment member attachable to said wheelchair.

5. An abduction wedge assembly for a wheelchair as claimed in claim 1 wherein said means for accommodating slidable movement of said slide member include a guide member on said slide member for said slide member, said slide member being slidably interengagable with said guide member during slidable movement of said slide member in said longitudinal direction.

6. An abduction wedge assembly for a wheelchair as claimed in claim 5 further including a releasable locking member supported on said guide member for detachable engagement with said slide member to lock said slide member in said selected longitudinally directed positions.

7. An abduction wedge assembly for a wheelchair as claimed in claim 5 wherein said guide member includes a receptacle for slidable accommodation of said slide member.

8. An abduction wedge assembly for a wheelchair as claimed in claim 5 wherein said means for pivotable movement of said slide member includes a pivot member extending through said guide member and said slide member.

9. An abduction wedge assembly for a wheelchair as claimed in claim 8 wherein said slide member includes an elongated slot having opposite ends, one end of said slot being moved toward said pivot member when said slide member is in said predetermined longitudinally directed position to permit pivoting of said slide member with respect to said support means.

10. An abduction wedge assembly for a wheelchair as claimed in claim 9 wherein said slide member has a free end portion and said guide member is in the form of a receptacle for slidable accommodation of said slide member, and said guide member includes a wall portion having a clearance recess sized to permit rotational movement of the free end portion of said slide member in said clearance recess when said slide member pivots with respect to said support means.

11. An abduction wedge assembly for a wheelchair as claimed in claim 1 further including locking means on said support means engagable with said slide member to lock the slide member in one of said selected longitudinally directed positions.

12. An abduction wedge assembly for a wheelchair as claimed in claim 1 wherein said means for pivotable movement of said slide member includes a pivot member on said support means and extending through said slide member such that said slide member is pivotable with respect to said support means.

13. An abduction wedge assembly for a wheelchair as claimed in claim 1 wherein said height adjustment member is protractable and retractable with respect to said slide member, said abduction wedge assembly further including means for locking said height adjustment member in a fixed position of predetermined protraction from said slide member.

14. An abduction wedge assembly for a wheelchair as claimed in claim 13 wherein said locking means include a locking member on one of said height adjustment member and said slide member for locking the position of said height adjustment member relative to said slide member.

15. An abduction wedge assembly for a wheelchair as claimed in claim 14 wherein said locking member is on said slide member and engages said height adjustment member to lock said height adjustment member in a selected protracted position relative to said slide member.

16. An abduction wedge assembly for a wheelchair comprising, a) an attachment member adapted to be joined to a wheelchair, b) a slidable member on said attachment member, and means on said attachment member for accommodating slidable movement of said slidable member such that said slidable member is slidably movable relative to said attachment member to a pivot position, said slidable member including pivot means such that said slidable member is pivotable with respect to said attachment member when said slidable member is in said pivot position, c) height adjustment means joined to said slidable member and including a height adjustment member movable relative to said slidable member to a selected predetermined protraction position, d) said height adjustment means further including means for locking said height adjustment member to said slidable member in said selected predetermined protraction position, and e) an abduction wedge member joined to said height adjustment member for slidable movement with said slidable member when said height adjustment member is locked to said slidable member, said abduction wedge member being pivotally movable with said slidable member when said slidable member is in said pivot position.

17. An abduction wedge assembly for a wheelchair as claimed in claim 16 wherein said pivot means includes a pivot member supported in a fixed position on said attachment member, and said slidable member includes a stop surface, said slidable member being movable in a first direction to a slide limit position wherein said stop surface engages said pivot member to prevent further slidable movement of said slide member, said slide limit position coinciding with said pivot position.

18. An abduction wedge assembly for a wheelchair as claimed in claim 17 wherein said slidable member includes a slot having end portions, one of said end portions including the stop surface that engages said pivot member when said slide member is in said slide limit position.

19. An abduction wedge assembly for a wheelchair as claimed in claim 16 wherein said locking means include means for permitting movement of said height adjustment member relative to said slide member and means for preventing such movement.

20. An abduction wedge assembly for a wheelchair as claimed in claim 19 wherein said locking means include a clamp provided on said slide member for clamping engagement with said height adjustment member.

21. An abduction wedge assembly for a wheelchair as claimed in claim 16 wherein said pivot means includes a pivot member on said attachment member in pivotal engagement with said slidable member when said slidable member is in said pivot position, such that said slidable member and said abduction wedge member are pivotably from a substantially horizontal orientation to a substantially vertical orientation.

* * * * *